United States Patent [19]

Greenberg

[11] Patent Number: 4,726,567

[45] Date of Patent: Feb. 23, 1988

[54] MASONRY FENCE SYSTEM

[76] Inventor: Harold H. Greenberg, 1826 N. Placita La Zarca, Tucson, Ariz. 85745

[21] Appl. No.: 907,886

[22] Filed: Sep. 16, 1986

[51] Int. Cl.[4] ..... E04H 17/16; E04C 3/26

[52] U.S. Cl. ..... 256/19; 52/169.9; 52/228; 52/293; 52/415; 52/573; 52/747

[58] Field of Search ..... 52/228, 293, 436, 573, 52/396, 227, 169.9, 300, 415, 747; 256/19

[56] References Cited

U.S. PATENT DOCUMENTS

| | | | |
|---|---|---|---|
| 701,588 | 6/1902 | Liebau | 256/19 |
| 1,148,228 | 7/1915 | Higgins | 52/300 X |
| 1,477,867 | 12/1923 | Dodson . | |
| 1,499,483 | 7/1924 | Simms | 52/293 X |
| 1,673,640 | 6/1928 | Rau | 52/396 |
| 1,704,255 | 3/1929 | Lewis . | |
| 1,723,216 | 8/1929 | Stam . | |
| 1,746,672 | 2/1930 | Nylund et al. . | |
| 2,102,447 | 12/1937 | Whitacre . | |
| 2,540,622 | 2/1951 | Langenberg | 52/293 |
| 2,627,176 | 2/1953 | Levy | 52/228 |
| 2,684,589 | 7/1954 | Perreton | 52/228 X |
| 2,877,989 | 3/1959 | Brodersen | 256/19 |
| 2,929,236 | 3/1960 | Steward et al. . | |
| 3,298,668 | 1/1967 | Schueren | 256/19 |
| 3,334,455 | 8/1967 | Russell . | |
| 3,468,094 | 9/1969 | Campbell | 52/169.9 X |
| 3,512,759 | 5/1970 | Resler | 256/19 |

FOREIGN PATENT DOCUMENTS

| | | | |
|---|---|---|---|
| 1059250 | 11/1953 | France | 52/293 |
| 79363 | 11/1951 | Norway | 52/436 |
| 100723 | 6/1916 | United Kingdom | 52/573 |
| 591494 | 8/1947 | United Kingdom | 52/228 |

*Primary Examiner*—Alfred C. Perham
*Attorney, Agent, or Firm*—Cahill, Sutton & Thomas

[57] ABSTRACT

A masonry fence is disclosed comprising a plurality of courses of masonry blocks mounted on a footer. The horizontal joint between adjacent courses is provided with a mortared joint while the vertical joint between adjacent blocks are interlocking without mortar. Post-tensioning rods are positioned at predetermined intervals along the fence and are imbedded at one end in a footer and extend upwardly through the vertical voids in the respective blocks to terminate in the next to highest course of blocks. The rods are post-tensioned and the highest course of block is mounted on top of the fence to enclose the top of the post-tensioning rods.

13 Claims, 7 Drawing Figures

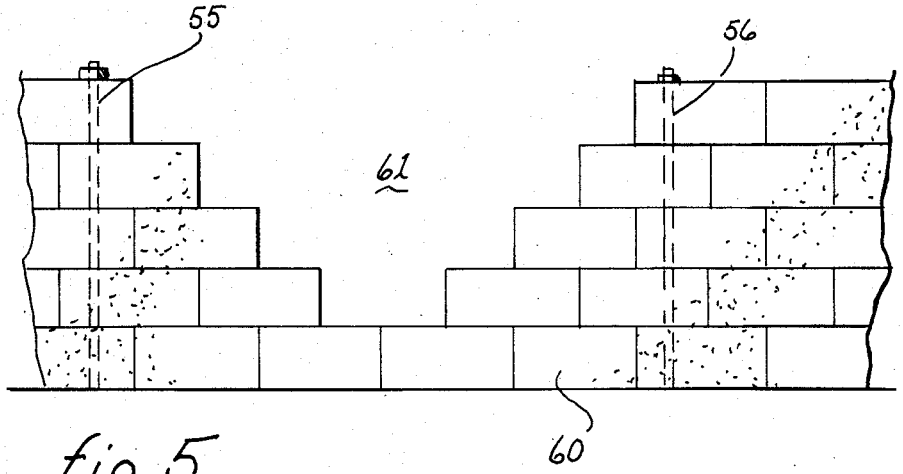
fig. 5
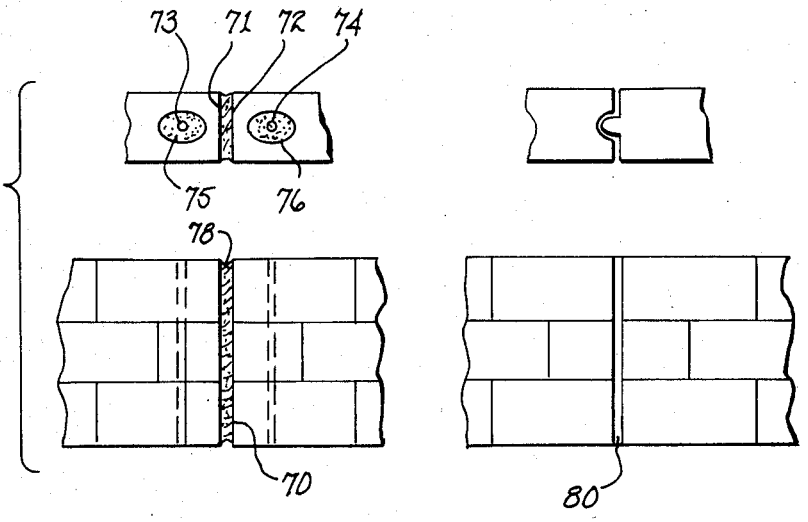
fig. 6
fig. 7
PRIOR ART

MASONRY FENCE SYSTEM

FIELD OF THE INVENTION

The present invention relates to masonry block systems, and more particularly to a fence constructed of masonry blocks having post-tensioning rods therein at spaced intervals.

DESCRIPTION OF THE PRIOR ART

The utilization of masonry fences or walls includes several considerations not the least of which is the structural integrity of the wall and the ability of the wall to withstand exterior forces such as wind loads while nevertheless remaining attractive and providing privacy and security. The expense of prior art masonry fences frequently dictates the utilization of a substitute type of fence that perhaps does not have the desireable characteristics of the masonry system. The weathering and aging characteristics of the masonry fence provide a permanent structure that requires little or no maintenance. Prior art masonry fences required frequent vertically extending reinforcing bars that were anchored in a concrete footer and extended upwardly through voids in the concrete blocks. The void in the respective masonry blocks surrounding the vertically extending reinforcing bar were filled with mortar to thereby provide a connection between the reinforcing bar and the masonry blocks of the wall. The spacing of the reinforcing bars was dictated by the requirement of the fence to be able to withstand exterior forces such as wind loads and required that such reinforcing bars always be placed adjacent the ends of the fence. In those instances where the fence extended for a substantial length, and it became necessary to include an expansion joint in the fence, the structural requirements of the reinforcing bar-type masonry fence required that reinforcing bars were placed adjacent the opposing ends of the expansion joint. Normally, the expansion joints comprised opposing wall section ends each of which had a vertically extending reinforcing bar therein imbedded in mortar within the vertical voids of the corresponding mortar blocks. To provide a wind and optical barrier at the gap between adjacent wall section ends, a plastic type filler was required that would lend continuity to the wall while nevertheless permitting the respective wall sections to expand and contract.

The construction of a prior art wall of the type described entailed substantial labor and materials expense which frequently discouraged the utilization of a masonry fence and rendered alternative fence types attractive.

OBJECTS OF THE INVENTION

It is therefore an object of the present invention to provide a masonry fence system incorporating all of the advantages of prior art fence systems at a lower cost in materials and labor.

It is also an object of the present invention to provide a masonry wall system that may more conveniently be constructed while nevertheless providing substantial structural integrity.

It is still another object of the present invention to provide a masonry block system that may be constructed using fewer man hours of labor while preserving the advantages of a masonry structure.

It is still another object of the present invention to provide a masonry wall system incorporating post-tensioning rods to insure structural strength and the ability of the wall to withstand external forces.

These and other objects of the present invention will become apparent to those skilled in the art as the description thereof proceeds.

SUMMARY OF THE INVENTION

The present invention incorporates the utilization of hollow masonry blocks positioned on top of a footer and having conventional mortared joints between respective courses. The vertical joints between adjacent blocks is mortarless and is accommodated through the utilization of interlocking or tongue-and-groove block configurations. Anchors are imbedded in the footer at predetermined intervals and are provided with threaded couplers for receiving and securing the bottom end of post-tensioning rods which extend vertically through voids in the masonry blocks. The post-tensioning rods are not mortared within the wall as previously used reinforcing bars required. The post-tensioning rods extend vertically to the next to highest course and are threaded at the upper end to permit the use of a washer and bolt to provide a means for tensioning the rod. The top course of the wall comprises closed top masonry blocks which have both horizontal and vertical mortared joints and are used to enclose the top of the fence including the top of the post-tensioning rods.

BRIEF DESCRIPTION OF THE DRAWINGS

The present invention may more readily be described by reference to the accompanying drawings in which:

FIG. 5 is an elevational view, partly schematic, of a masonry block fence and is useful in describing the effects of post-tensioning forces on the wall.

FIG. 6 is an illustration of a prior art expansion joint.

FIG. 7 is an illustration of an expansion joint of the wall of the present invention.

Referring now to FIGS. 1 through 4, a masonry block wall 10 comprises a plurality of courses 12 through 17 mounted on a footer 20. The horizontal joints such as that shown at 25 between adjacent courses is mortared in a conventional masonry block fashion. However, the vertical joints between adjacent blocks such as that shown at 26 are not mortared, the joints being provided by tongue-and-groove block configurations (also referred to as interlocking blocks). The block configuration may best be seen by reference to FIG. 4. The blocks include vertically extending voids 28 and may incorporate vertically extending ridges 29 on one side and corresponding grooves 30 on the opposite side. Alternatively, some of the blocks are open ended as shown at 35 while still other blocks may be provided with smooth ends such as that shown at 36.

Figure 1:
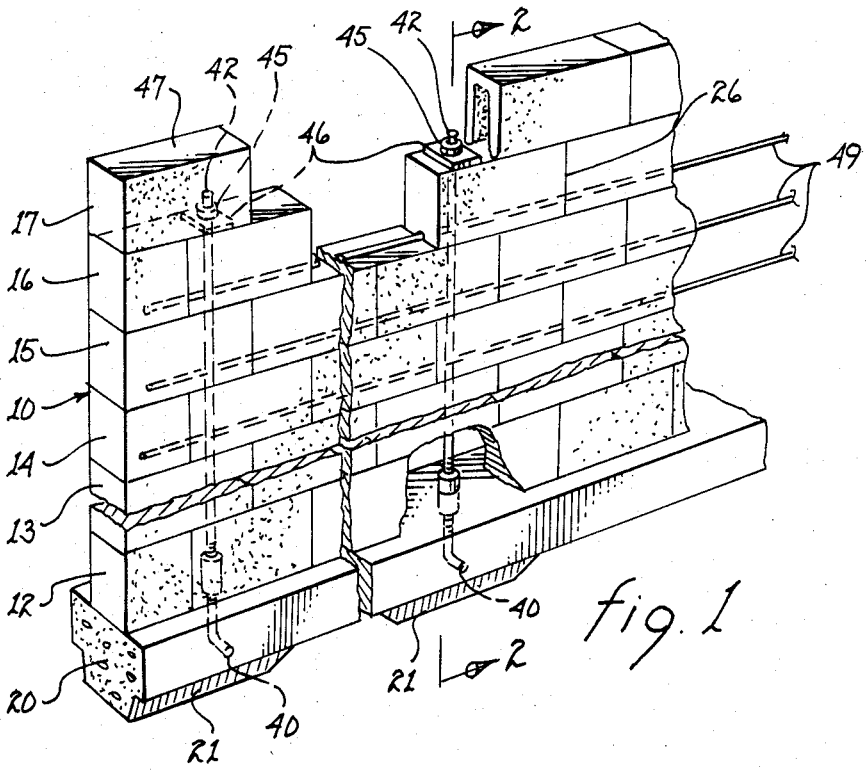
FIG. 1 is a perspective view of a masonry block fence constructed in accordance with the teachings of the present, invention.
Figure 2:
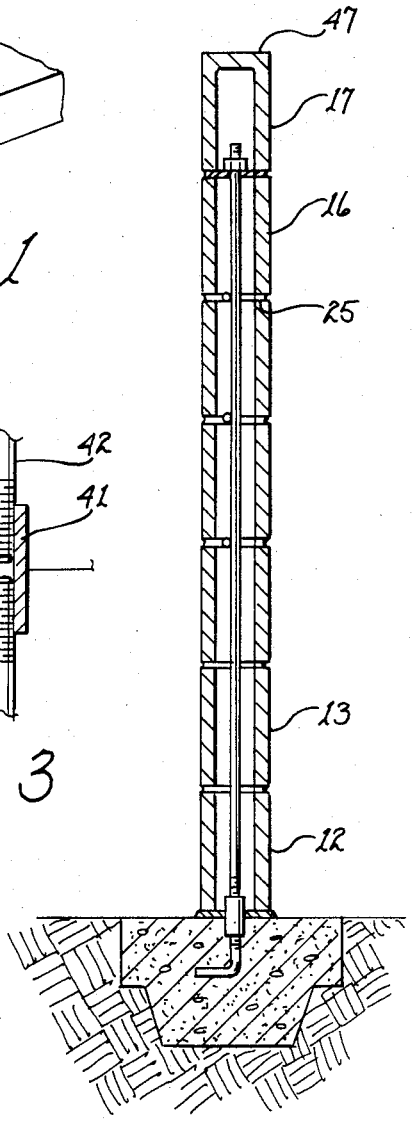
FIG. 2 is a cross-sectional view of the fence of FIG. 1 taken along line 2—2.
Figure 3:
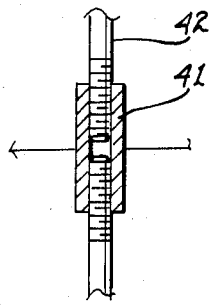
FIG. 3 is an enlarged view, in section, of a threaded showing the interconnection of an anchor with the post-tensioning rod.
Figure 4:
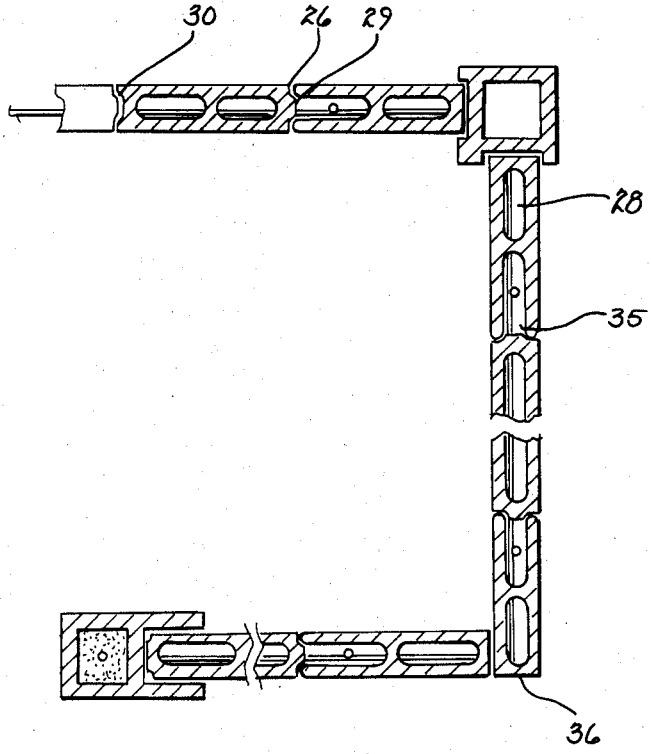
FIG. 4 is a top view, partly in section, showing various features of walls constructed in accordance with the teachings of the present invention.

Anchors 40 are imbedded in the footer 20 at predetermined intervals and extend upwardly to engage couplers 41 having internal threads to receive and threadedly interconnect with corresponding vertically extending post-tensioning rods 42. It is important to note that the post-tensioning rods extend vertically through the voids 28 in the corresponding masonry blocks and terminate slightly above the next to highest course 16 and below the highest course 17.

The ends of the post-tensioning rods 42 are threaded to receive corresponding nuts 45 which engage washers 46 that contact the upper surface of the masonry blocks. The utilization of selected open-ended masonry blocks is important in the construction of the wall system of the present invention. The anchors 40 are imbedded in the footer 20 and the corresponding vertically extending post-tensioning rods 42 are threadedly engaged through the couplers 41. When the masonry blocks of the respective courses are then laid, conventional horizontal mortar joints are used. However, when the mason encounters a vertically extending post-tensioning rod such as those shown at 42, an open ended masonry block such as that shown at 35 is used to permit the mason to simply position the block around the post-tensioning rod without having to thread the block over the rod. Thus, the combination of masonry blocks having closed ends with those having one open end permits the rapid laying of successive courses using conventional masonry techniques and without the inconvenience and time consuming manipulation of individual blocks being placed over rods and lowered into place. The anchors 40 are also positioned in abutting relationship to reinforcing bar 44 imbedded in the footer 20.

After the mortar between successive courses has sufficiently hardened, the nuts 45 are tightened to provide the design post-tensioning force on the respective post-tensioning cables. The top course 17 is formed of masonry blocks having a closed top 47 and is provided with a horizontal and vertical mortar joint; the blocks of the top course may be filled with mortar and placed on top of the ends of the post-tensioning rods to thereby encase the latter and permanently secure the post-tensioning rods in position and prevent tampering with the tensioning rod after the wall is complete.

The footer 20 is provided with increased depth at those positions 21 corresponding to the positions at which the anchors 40 are imbedded in the footer. In this way, sufficient footer strength is provided as well as sufficient material surrounding the bottom of the anchor to prevent the intrusion of excess moisture as well as to prevent the generation of cracks at the points of force created by the post-tensioning of the post-tensioning rods. Horizontal reinforcing wires 49 may be included between the upper courses to add to the structural integrity of the wall; the reinforcing wires 49 are shown merely as exemplary, it being understood that conventional wall techniques frequently employ preformed horizontal reinforcing wire incorporating parallel wires that extend along the joint on both edges of the joint and also incorporates transverse wires extending from one side of the masonry block to the other in an "H" configuration. The latter type of horizontal reinforcing wire is desired and would normally be more effective than the single wires shown in FIG. 1.

When the post-tensioning rods are post-tensioned, the forces exerted by the rod result in compression of the blocks being contacted by the respective washers. These blocks in turn compress those blocks in the next lower course. As the compressive force is transmitted downwardly, the force is carried by larger and larger numbers of masonry blocks. Referring to FIG. 5, a portion of a masonry wall utilizing post-tensioning rods 55 and 56 is shown. Only those masonry blocks experiencing compressive force from the respective post-tensioning rods are shown. It is an important feature of the present invention that the bottom course 60 experience compressive forces from the post-tensioning cables; the maximum spacing between the post-tensioning rods 55 and 56 is thus determined by the requirement that all of the masonry blocks in the lowest course 60 be under compression from the post-tensioning forces. It may also be noted that all of the blocks that would be in the space 61 in FIG. 5 do not experience post-tensioning forces and thus must rely upon the other structural features of the masonry fence to maintain structural integrity. These other structural features include the mortar joints on the horizontal joints between the respective courses as well as the interlocking vertical joints; further, the wire reinforcing provided between the upper courses also provides structural reinforcement for these upper courses that are not subject to the compressive force of post-tensioning. The use of post-tensioning however provides substantial structural strength such that a narrower masonry block may be utilized in the construction of the fence.

As mentioned previously in connection with the construction of substantial lengths of masonry fence, expansion joints must be provided to permit the wall to expand and contract. These expansion joints in prior art structures take the form schematically represented in FIG. 6. It may be seen there that the vertically extending expansion joint 70 is merely a space between opposing ends 71 and 72 of wall sections. Since these ends of the wall sections would otherwise be unsupported, it is necessary to incorporate reinforcing bars 73 and 74 imbedded in mortar 75 and 76 within those blocks adjacent to the joint 70. To provide a continuity of privacy to the wall, as well as providing wind protection, the joint is frequently filled with a plastic or rubber-like substance 78. In contrast to the complications caused by the requirements of expansion joints in prior art masonry wall systems, the wall system of the present invention may easily provide an expansion joint as shown in FIG. 7. Referring to FIG. 7 the expansion joint 80 is readily accommodated through the utilization of the tongue and groove or interlocking masonry blocks which inherently provide continuity to the wall while insuring privacy and wind blockage at the expansion joint between opposing sections of the wall. It may be noted that since the wall of the present invention is anchored through the utilization of post-tensioning rods, it is not necessary to place the post-tensioning rods adjacent to the expansion joint; rather, the wall may simply be extended to the joint and constructed in accordance with the techniques described above in connection with the present invention. It may be noted however that it will still be necessary to insure that the lowest course of the wall of the present invention experiences compressive force from the nearest post-tensioned rods.

It may be possible to construct a wall in accordance with the teachings of the present invention without using horizontal mortar joints. That is, it may be possible to eliminate the mortar from between adjacent courses; however, it would be necessary to insert some type of binder such as an epoxy or similar binding agent between the horizontal joints at least between those blocks that are not under compression from the tensioning of the post-tensioning rods. For example, the horizontal joints of the courses shown in FIG. 5 may be laid without mortar; however, the masonry blocks that would be placed in the space 61 would have to be provided with an epoxy binding agent, or similar binding agent, between the blocks since those horizontal joints are not under compression.

In the process of construction of the masonry fence of the present invention, it may be found convenient to insert the anchors into the footer while the concrete is still wet and in its plastic state. In such cases, the anchor is simply pushed into the concrete and then rotated 90° to insure that the anchor locks beneath the reinforcing bar previously positioned in the footer. It is most convenient to lay the first course of masonry blocks on the footer while the latter is in its plastic stage. In this manner, the masonry blocks may simply be positioned on the footer and the anchor, with coupler attached, may be inserted in the void within the blocks and pushed into the plastic concrete and rotated. By using the latter technique, the positioning and alignment of the respective anchors and couplers with regard to the masonry blocks is automatic.

It may therefore be seen that the present invention provides a masonry wall system that incorporates conventional masonry techniques while still providing extreme structural integrity without the expense and materials and labor of prior art wall systems. The wall systems of the present invention may incorporate expansion joints or other structural features without the previously required inclusion of vertically extending reinforcing bars with mortar filled voids surrounding the bar.

I claim:

1. A masonry fence comprising:
(a) a footer;
(b) a plurality of courses of masonry blocks mounted on said footer, each of said blocks having vertical mortarless voids therein, the horizontal joints between adjacent courses being mortared, the vertical joints between adjacent blocks being interlocking without mortar;
(c) a plurality of post-tensioning rods positioned at predetermined intervals along said fence, each secured at one end to said footer and extending upwardly therefrom through said vertical mortarless voids to an upper end;
(d) selected ones of said masonry blocks in each course being open ended to permit said blocks to be placed on top of a lower course without threading said block over a post-tensioning rod; and
(e) means secured to each of said upper ends for tensioning a corresponding post-tensioning rod.

2. A masonry fence comprising:
(a) a footer;
(b) a plurality of courses of masonry blocks mounted on said footer, each of said blocks having vertical mortarless voids therein, the horizontal joints between adjacent courses being mortared, the vertical joints between adjacent blocks being interlocking without mortar;
(c) a plurality of post-tensioning rods positioned at predetermined intervals along said fence, each secured at one end to said footer and extending upwardly therefrom through said vertical mortarless voids and terminating at an upper end below the highest course of block and above the second highest course of block; and
(d) means secured to each of said upper ends for tensioning a corresponding post-tensioning rod.

3. A masonry fence comprising:
(a) a footer;
(b) a plurality of courses of masonry blocks mounted on said footer, each of said blocks having vertical mortarless voids therein, the horizontal joints between adjacent courses being mortared, the vertical joints between adjacent blocks being interlocking without mortar;
(c) a plurality of post-tensioning rods positioned at predetermined intervals along said fence, each secured at one end to said footer and extending upwardly therefrom through said vertical mortarless voids and terminating at an upper end below the highest course of block and above the second highest course of block;
(d) selected ones of said masonry blocks in each course being open ended to permit said blocks to be placed on top of a lower course without threading said block over a post-tensioning rod; and
(e) means secured to each of said upper ends for tensioning a corresponding post-tensioning rod.

4. The masonry fence of claim 3 wherein the masonry blocks in the top course of blocks are closed on top to thereby enclose the upper ends of said post-tensioning rods.

5. The combination as set forth in claim 4 wherein the vertical joints between adjacent blocks in the top course of blocks are mortared.

6. The combination as set forth in claim 3 wherein said means is secured to each of said upper ends is a nut threadedly engaging the upper end of a post-tensioning rod and wherein said nut bears upon a washer contacting a portion of a top surface of a masonry block in the next to highest course of the fence.

7. The combination as set forth in claim 3 wherein said footer has a uniform thickness except at post-tensioning rod positions and extends to a greater depth at those positions.

8. The combination as set forth in claim 3 including a plurality of anchors imbedded in said footer each having a threaded coupling for attachment to a respective post-tensioning rod to anchor the rod to said footer.

9. The combination as set forth in claim 3 wherein said post-tensioning rods, when tensioned, apply compressive force to some, but not all, said masonry blocks, and wherein all blocks in the lowest course of said fence are under compressive force from said post-tensioning rods.

10. The combination as set forth in claim 9 wherein the maximum distance between post-tensioning rods is that distance which provides compressive force from said rods to all masonry blocks in the lowest course of blocks but less than all masonry blocks in the next to lowest course of blocks.

11. A masonry fence comprising:
(a) a footer;
(b) a plurality of courses of masonry blocks mounted on said footer, each of said blocks having vertical mortarless voids therein, the vertical joints between adjacent blocks being interlocking without mortar, the horizontal joints between courses being without mortar;
(c) a plurality of post-tensioning rods positioned at predetermined intervals along said fence, each secured at one end to said footer and extending upwardly therefrom through said vertical mortarless voids to an upper end;

(d) said post-tensioning rods, when tensioned, applying compressive force to some, but not all, said masonry blocks, all blocks in the lowest course of said fence being under compressive force from said post-tensioning rods;

(e) binding means positioned in all horizontal joints between masonry blocks not under compressive force from said post-tensioning rods; and (f) means secured to each of said upper ends for tensioning a corresponding post-tensioning rod.

12. The method of forming a masonry fence having a plurality of courses of masonry blocks, comprising the steps of:

(a) pouring a concrete footer;

(b) laying a first course of masonry blocks on said footer while said concrete is plastic;

(c) inserting anchors, at predetermined intervals along said footer, through the masonry blocks of said first course and into said plastic cement;

(d) attaching post-tensioning rods to said anchors;

(e) laying a plurality of courses of masonry blocks with horizontal mortar joints and mortarless interlocking vertical joints;

(f) positioning a nut and washer on each post-tensioning rod; and (g) applying a post-tensioning force to each of said post-tensioning rods by tightening the corresponding nuts.

13. The method of forming a masonry fence having a plurality of cources of masonry blocks, comprising the steps of:

(a) pouring a footer;

(b) securing anchors at predetermined intervals along said footer, said predetermined intervals selected to provide a compressive force exerted by post-tensioning rods on each block in the lowest course of said fence;

(c) attaching post-tensioning rods to said anchors;

(d) laying a plurality of courses of masonry blocks with horizontal mortar joints and mortarless interlocking vertical joints;

(e) positioning a nut and washer on each post-tensioning rod;

(f) applying a post-tensioning force to each of said post-tensioning rods by tightening the corresponding nuts; and (g) laying a top course of closed top masonry block using mortared horizontal and mortared vertical joints.

* * * * *